US012606361B2

(12) United States Patent
Heetfeld et al.

(10) Patent No.: US 12,606,361 B2
(45) Date of Patent: Apr. 21, 2026

(54) SINGLE PIECE ACTUATOR WITH SLIDER LOCK

(71) Applicant: PRECISION VALVE CORPORATION, Greenville, SC (US)

(72) Inventors: Rainer Heetfeld, Frankfurt am Main (DE); Matthew L. Brett, Toronto (CA); John B. Fore, Travelers Rest, SC (US)

(73) Assignee: PRECISION VALVE CORPORATION, Greenville, SC (US)

( * ) Notice: Subject to any disclaimer, the term of this patent is extended or adjusted under 35 U.S.C. 154(b) by 147 days.

(21) Appl. No.: 18/785,549

(22) Filed: Jul. 26, 2024

(65) Prior Publication Data

US 2025/0042644 A1 Feb. 6, 2025

Related U.S. Application Data

(60) Provisional application No. 63/516,679, filed on Jul. 31, 2023.

(51) Int. Cl.
*B65D 83/224* (2025.01)
*B65D 83/206* (2025.01)

(52) U.S. Cl.
CPC ..... *B65D 83/228* (2013.01); *B65D 83/206* (2013.01)

(58) Field of Classification Search
CPC ..... B65D 83/206; B65D 83/228
See application file for complete search history.

(56) References Cited

U.S. PATENT DOCUMENTS

| | | | |
|---|---|---|---|
| 6,691,896 | B2 | 2/2004 | Meshberg |
| 7,070,069 | B2 | 7/2006 | Ho |
| 7,249,692 | B2 | 7/2007 | Walters et al. |
| 7,530,476 | B2 | 5/2009 | Downey et al. |
| 7,699,190 | B2 | 4/2010 | Hygema |
| 7,861,894 | B2 | 1/2011 | Walters et al. |
| 8,100,298 | B2 | 1/2012 | Marquardt et al. |
| 8,127,968 | B2 | 3/2012 | Yerby et al. |
| 9,216,852 | B2 | 12/2015 | Cho et al. |
| 10,577,169 | B2 | 3/2020 | Bodet et al. |
| 10,730,690 | B2 | 8/2020 | Dodd et al. |
| 11,332,300 | B2 | 5/2022 | Stenghel et al. |
| 2002/0008119 | A1 | 1/2002 | Clark et al. |
| 2006/0113329 | A1 | 6/2006 | Walters et al. |

(Continued)

FOREIGN PATENT DOCUMENTS

| | | | |
|---|---|---|---|
| WO | 2021/140133 | A1 | 7/2021 |

OTHER PUBLICATIONS

International Search Report and Written Opinion dated Oct. 21, 2024 from corresponding International Patent Application No. PCT/US2024/039760, 13 pages.

*Primary Examiner* — Jeremy Carroll

(74) *Attorney, Agent, or Firm* — Ruggiero McAllister & McMahon LLC

(57) ABSTRACT

An actuator has a slidable body that is slidable between a first position in which the actuation of a valve is blocked by the slidable body and a second position in which the valve can be actuated. The actuator, together with the slidable body, is formed as one piece. In an initial state, the actuator and the slidable body are connected by gates that are frangible. A tether can connect the actuator to the slidable body so that after the gates are fractured, the actuator, together with the slidable body, is still one piece.

23 Claims, 11 Drawing Sheets

(56) References Cited

U.S. PATENT DOCUMENTS

| | | | | |
|---|---|---|---|---|
| 2007/0235474 | A1* | 10/2007 | Downey | B65D 83/228<br>222/153.11 |
| 2008/0290113 | A1 | 11/2008 | Helf et al. | |
| 2014/0367410 | A1* | 12/2014 | Tryon | B65D 83/145<br>222/402.1 |
| 2018/0155112 | A1* | 6/2018 | Fritzler | B65D 83/18 |
| 2019/0202624 | A1* | 7/2019 | Andrews | B65D 83/303 |

* cited by examiner

SINGLE PIECE ACTUATOR WITH SLIDER LOCK

CROSS-REFERENCE TO RELATED APPLICATIONS

The present application claims the benefit of U.S. Provisional Patent Application No. 63/516,679 filed Jul. 31, 2023, which is incorporated by reference herein in its entirety.

BACKGROUND OF THE DISCLOSURE

1. Field of the Disclosure

The present disclosure relates to an actuator for an aerosol or propellant-based dispensing system, namely an actuator that is attachable to a container and can actuate a valve to dispense a product from the container. More particularly, the present disclosure relates to such an actuator having a body that is slidable between a first position in which a valve can be actuated and a second position in which the valve cannot be actuated. Still more particularly, the present disclosure relates to such an actuator that is injection molded in one piece. The present disclosure also relates to a method of making and assembling such an actuator.

2. Description of Related Art

Lockable aerosol or propellant based dispensers on the market have actuators with various different structural designs of interrelating parts. Some of these designs require multiple components and require assembly. Automated assembly can require machinery that is expensive to design, manufacture, and operate. Some of these designs are tricky for a user to operate between locked and unlocked states. For example, some require two handed operation or more force than desirable. Others require rotation of components relative to each other about a central axis of the aerosol or propellant-based dispenser. Still others require the removal of locking components to unlock. These locking components are often small and easy to misplace. Once misplaced, these designs can no longer be locked.

Accordingly, it has been determined by the present disclosure that there is a continuing need for an actuator for a propellent-based dispensing system that overcomes, alleviates, and/or mitigates one or more of the aforementioned and other deleterious effects of prior devices.

SUMMARY OF THE DISCLOSURE

The present disclosure provides an actuator with an actuation blocking feature for use with an aerosol or propellant-based dispensing system.

The present disclosure further provides an actuator having a slidable body that is slidable between a first position in which the actuation of a valve is blocked by the slidable body and a second position in which the valve can be actuated. In the first position, the aerosol or propellant-based dispensing system is considered to be locked.

The present disclosure still further provides an actuator that, together with the slidable body, is formed as one discrete piece. In an initial state, the actuator and the slidable body are connected by gates that are frangible. In examples where the actuator is formed by injection molding, the gates function as filling slots through which plastic flows during molding. The actuator can also be formed, for example, by additive manufacturing.

After forming, the gates are fractured or severed so that the slidable body can be positioned on the actuator in an operating state of the actuator. Once positioned on the actuator, the slidable body is slidable between a position that prevents actuation of the valve and a position that permits actuation of the valve.

A tether can connect the actuator to the slidable body so that after the gates are fractured, the actuator, together with the slidable body, is still one piece.

The tether is flexible and can serve to guide the slidable body into the operating state of the actuator from the initial state. The tether does not interfere with the movement of the slidable body.

An actuator, according to the present disclosure, is attachable to a container and actuates a valve to dispense product from the container. The actuator has an initial state and an operating state. The actuator is presented or formed in the initial state and assembled to be in the operating state. In the operating state, the actuator has a blocked position and an unblocked position. The actuator has a shroud mountable on the container. The shroud has a slot defined therethrough. The slot has a first side and a second side opposite the first side. A conduit fluidly communicates a dispensing orifice at a first end of the conduit and the valve at a second end of the conduit. The second end is opposite the first end. A pushbutton is levered to the shroud to be reciprocally movable in the shroud between an actuated valve position and an non-actuated valve position. The pushbutton has a tab that projects downward from a bottom surface of the pushbutton. The actuator includes a slidable body with a slider and a blocker extending from the slider and disposed perpendicular to the slider or at an angle up to 45° off perpendicular. A gate connects the blocker to the shroud in the initial state of the actuator. The gate is frangible, for example, by an inward radial movement of the slidable body to position the slidable body through the slot and thus assembling the actuator in the operating state of the actuator. In the operating state, the blocker is disposed through the slot, and the slider is disposed adjacent to an outside surface of the shroud. Also, in the operating state of the actuator, the slidable body is slidable by movement of the slider between the blocked position where the slider is at the first side of the slot and the unblocked position where the slider is at the second side of the slot. In the blocked position, the blocker is positioned below the tab to prevent movement of the pushbutton to the actuated valve position.

The actuator also includes a tether that can be arcuate and flexible. The tether connects the slider to the first end or the second end of the slot, both when the actuator is in the initial state and when the actuator is in the operating state.

The tether can be positioned to be arced away from the blocker.

The sliding element can have a pair of spaced-apart blockers and a respective pair of gates. Each blocker can be one, two, or more blockers. There can also be one, two, or more respective gates.

Each blocker can be, for example, a bar or a rod.

Each blocker can have a sloped lip projecting from a top surface thereof to provide stability of and prevent removal of the slidable body from the operating state.

The slot can have a bottom side and the gate can connect the blocker to the bottom side of the slot.

The one or more gates are dimensioned so that the actuator is moldable as a single discrete component together with the sliding body.

The initial state can be an as-molded state or an as-additively manufactured state.

The slidable body can have a grippable texture or surface feature on an outside surface of the slider.

The slider can have a pair of finger-engageable tabs with the tabs projecting outward at opposite ends of the slider.

The tab can project downward from an edge of the pushbutton.

The tab can have a notch dimensioned to have a width greater than a width of the blocker. The tab can also have a notch that aligns with, and is structured to receive, the blocker therethrough when the slidable body is in the unblocked position.

The actuator can have a pair of mutually interlocking retaining latches to reduce rocking and tilting of the slidable body in the operating state. One latch is disposed on the shroud and the other latch is disposed on the slidable body.

The actuator can have a clicking post disposed on the slidable body that produces a tactile and/or audible click when the clicking post passes over a projection that projects from the shroud.

The actuator can have a tamper-evident feature. The tamper-evident feature can be, for example, a frangible rib connecting the pushbutton to a top edge of the shroud.

The actuator or shroud can be structured to be mountable to a can of the container. Alternatively, the actuator or shroud can be structured to be mountable to a cup of the container.

The present disclosure also provides a method for making an actuator according to the present disclosure.

The actuator can be injection molded by injecting plastic into a mold via a gate. The actuator can then be assembled by applying an inward radially directed force to the slidable body to fracture the gate and push the blocker or blockers through the slot until the slider is adjacent to an outside surface of the shroud.

The inward radially directed force can also cause the arcuate flexible tether to fold on itself and project through the slot so that the actuator is slidably lockable while being a single discrete component.

In example methods, the assembling can be performed during removal of the component from the mold. In other example methods, the assembling can be performed after removal of the component from the mold.

The injection molding can be performed with one or two different plastics so that the actuator is co-molded.

BRIEF DESCRIPTION OF THE DRAWINGS

It should be noted that when the same reference number is used in different figures of the drawings, the reference number refers to the same or like part.

DETAILED DESCRIPTION OF THE DISCLOSURE

Figure 1:
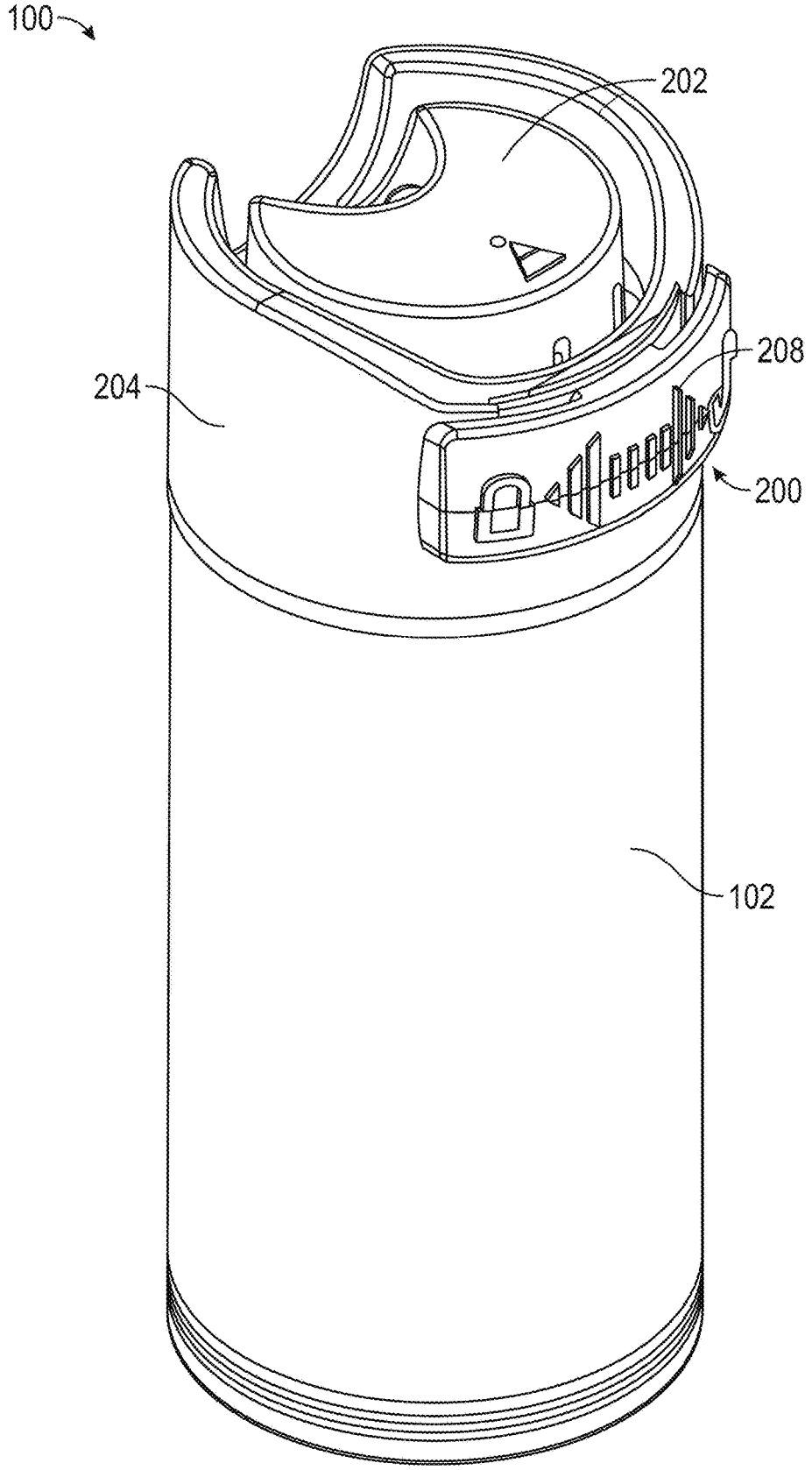
FIG. 1 is a rear isometric view of a container having an actuator according to the present disclosure.
Figure 2:
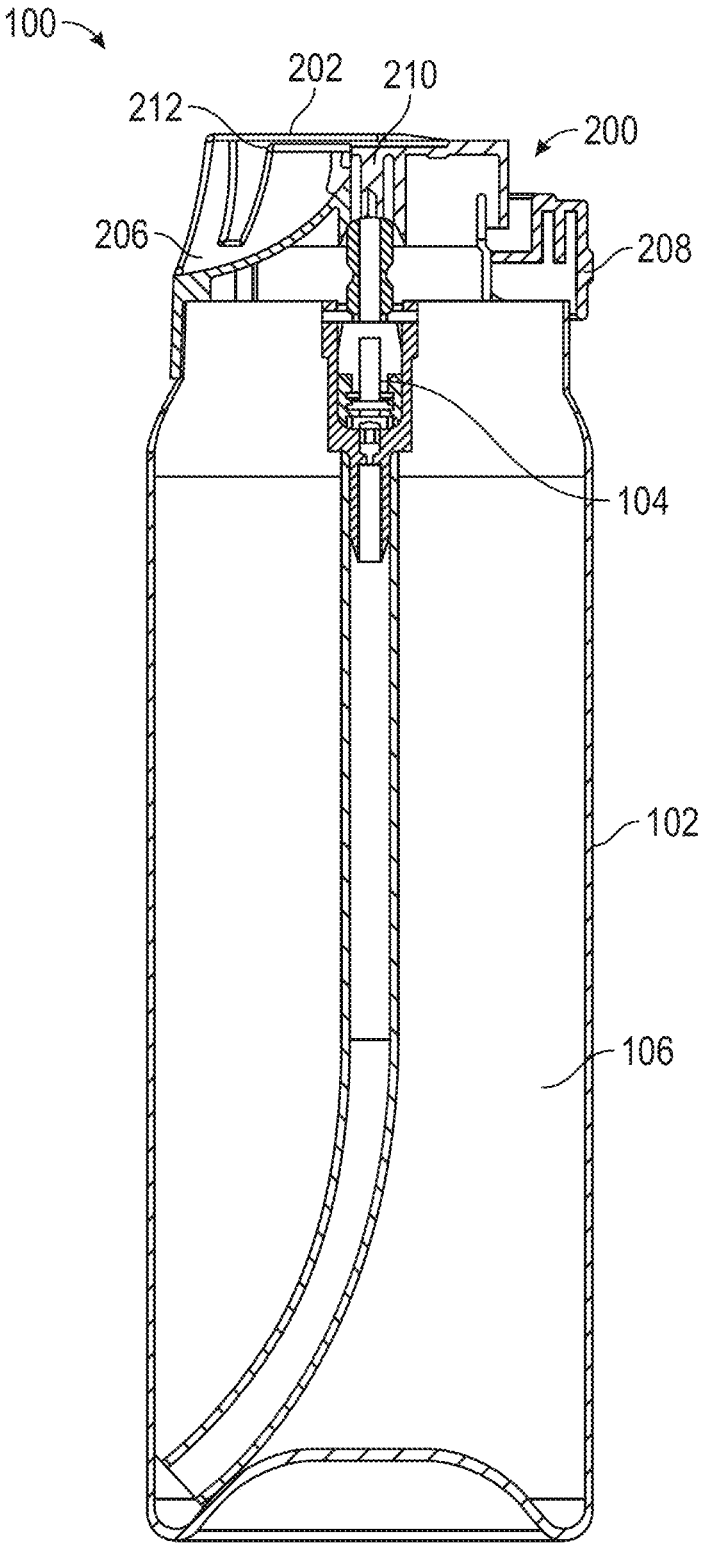
FIG. 2 is a section view of the container and actuator of FIG. 1.

Referring to the drawings and in particular to FIGS. 1 and 2, there is shown a dispensing system 100. Dispensing system 100 includes an actuator 200 that is attachable to a container 102 and that can actuate a valve, such as valve 104, to dispense product 106 from the container.

Actuator 200 has a slidable body 208 that is slidable between a first position in which valve 104 can be actuated and a second position in which actuation of the valve is blocked. Consequently, in the second position, an actuation of valve 104 is prevented.

Actuator 200 is operable by a pushbutton 202. Pushbutton 202 is levered to a shroud 204 at a hinge 206. Pushbutton 202 is engageable by a user and reciprocally movable in shroud 204 to actuate valve 104. Shroud 204 is mountable on container 102 and is shown mounted on a can.

Referring to FIG. 2, actuator 200 has a conduit 210 that fluidly communicates valve 104 with an orifice 212 through which a product is dispensed or sprayed. Thus, the application of a force F on pushbutton 202 causes a downward movement of the pushbutton and, in turn, to actuate, i.e., open, valve 104. When valve 104 is open, pressure in container 102 causes the product to flow through the valve, conduit 210, and out orifice 212. In this way, product is dispensed or sprayed from container 102.

Actuator 200, together with slidable body 208, is formed as one piece.

Figure 3:
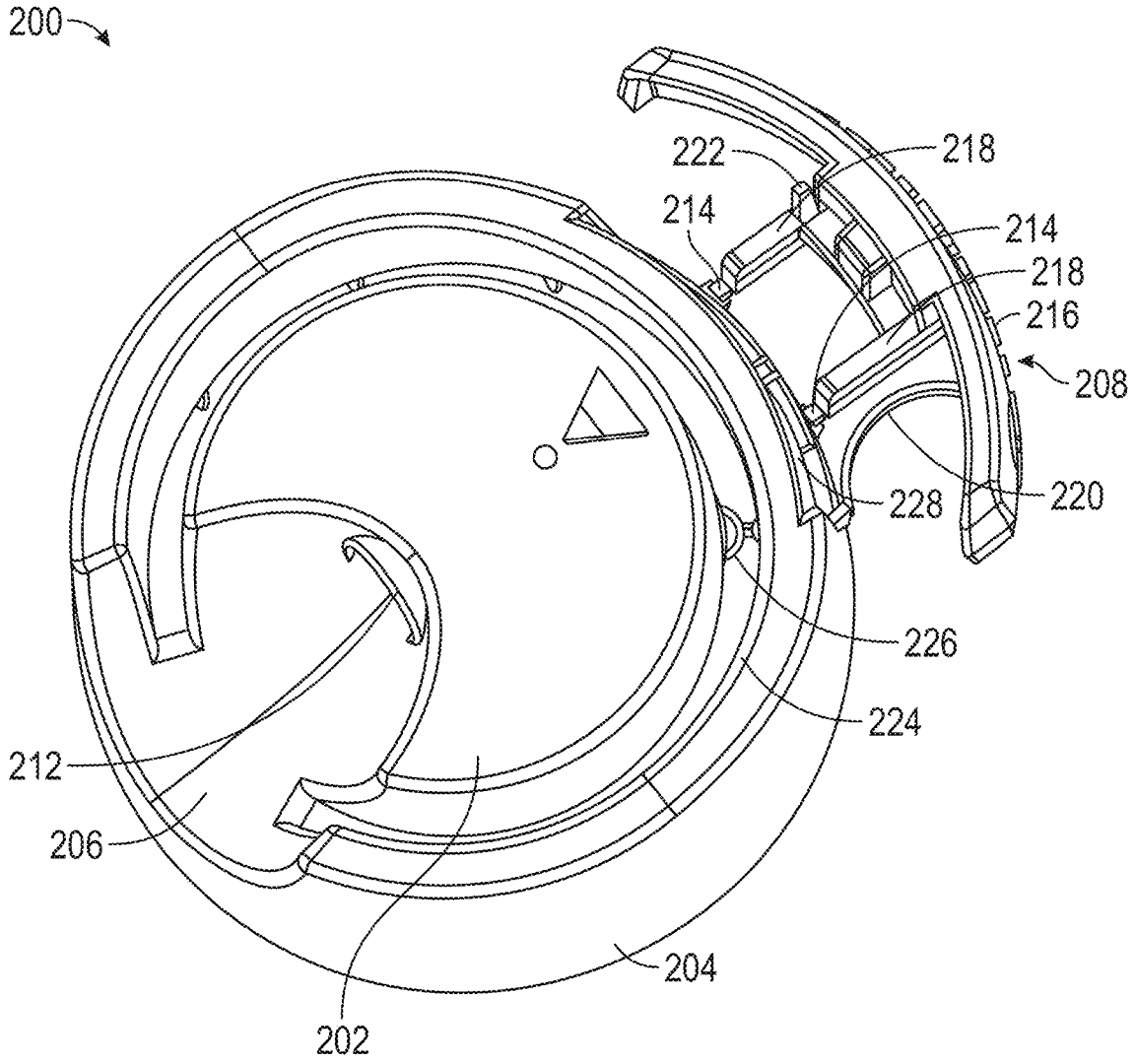
FIG. 3 is a top perspective view of the actuator shown in FIG. 1 in an initial state.
Figure 4:
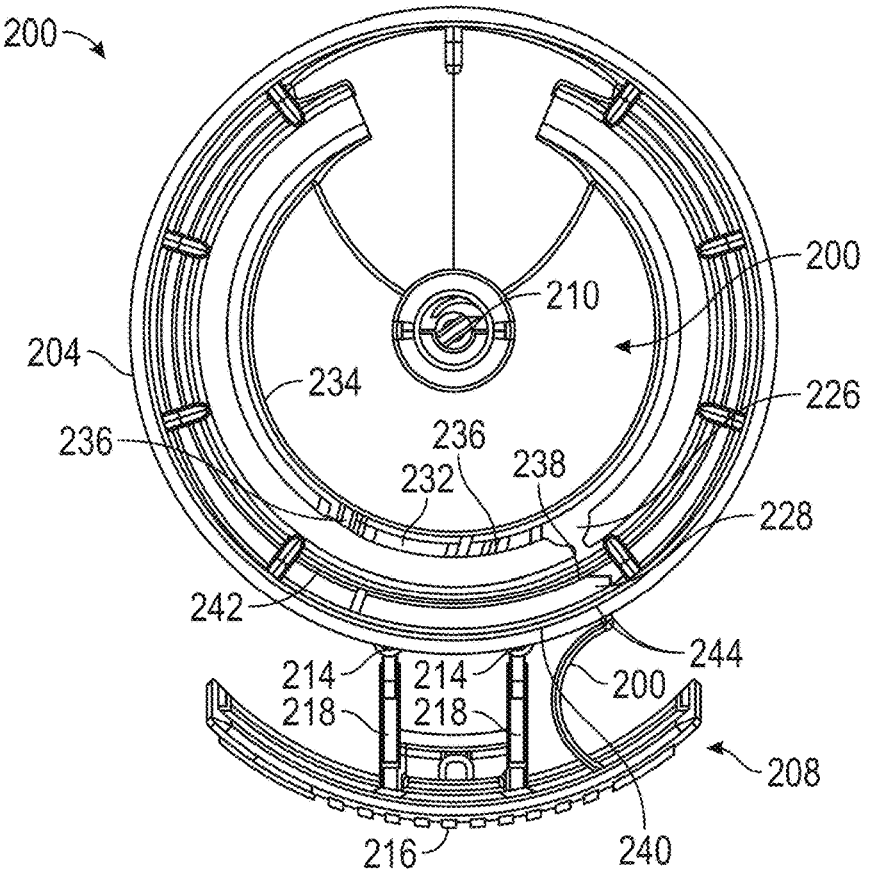
FIG. 4 is a bottom view of the actuator shown in FIG. 1 in the initial state.

Actuator 200 is shown in an initial state in FIGS. 3 and 4. In the initial state, shroud 204 and slidable body 208 are connected by gates 214, which are frangible.

Gates 214 are fractured during assembly of actuator 200 to position slidable body 208 into an operating state that is shown in FIGS. 5 to 10.

Slidable body 208 includes a slider 216 and blocker 218. Blocker 218 extends from slider 216. Blocker 218 is disposed perpendicular to slider 216. Although blocker 218 is shown perpendicular to slider 216, the blocker can be disposed at an angle of 45° to 135° relative to the slider.

Blocker 218 is a structure that, in the operating state, blocks a downward movement of pushbutton 202 in certain positions to prevent actuation of valve 104. Blocker 218 can be a bar or a rod.

Slider 216 is a user-engageable member that, in the operating state, moves blocker 218 relative to pushbutton 202 between a blocked position and an unblocked position.

Referring back to the example shown in FIGS. 3 and 4, there are two blockers 218 and two gates 214. Gates 214 connect shroud 204 to respective blockers 218.

A tether 220 connects slidable body 208 to shroud 204. Tether 220 is arcuate and flexible. As shown, tether 220 is positioned to arc away from blocker 218. Tether 220 remains connected to slidable body 208 and shroud 204 so that although there are moving components, actuator 200 is one piece. In other embodiments, tether 220 can have preset bending points for multiple folding.

Actuator 200 includes a tamper-evident feature 226. Tamper evident feature 226 is a visible feature that indicates whether actuator 200 has been actuated at least once, for example, an irreversible seal. In the example shown, tamper evident feature 226 is a frangible rib that connects pushbutton 202 to a wall 224 of shroud 204. Upon a first actuation using pushbutton 202, the rib will sever. Thus, a user will be able to visibly determine whether the dispensing system has been previously used or potentially adulterated. The rib is located at a rear half of pushbutton 202 that is opposite hinge 206 so that a force that severs the rib is minimal. In some examples, the rib is off center, for example between a 4 o'clock and a 5 o'clock position or 7 o'clock and an 8 o'clock position relative to an orientation in which orifice 212 is at a 12 o'clock position.

Pushbutton 202 can include a finger pad with one or more surface features or textures to facilitate grip and user operability.

Hinge 206 is a living hinge or flexure bearing. Hinge 206 can have a thinned portion to facilitate bending.

Actuator 200 can have an audible or tactile feature that indicates to a user when slidable body 208 is moved between the blocked and unblocked positions. As shown, actuator 200 has a clicking post 222 disposed on slidable body 208 that produces a tactile and/or audible click when the clicking post passes over a projection 223 projecting from the shroud shown in FIG. 6.

Reference is now made specifically to FIG. 4 which is a bottom view of actuator 200 in the initial state. Here, a bottom surface 230 of pushbutton 202 is shown.

Conduit 210 extends downward from bottom surface 230. As can be seen, the lower portion of conduit 210 is operably structured to communicate with and actuate valve 104.

A tab 232 also extends downward from bottom surface 230, and as shown, specifically from an edge 234 of the bottom surface. Tab 232 is a protrusion or finger that, in the operating state of actuator 200, can be blocked by blocker 218, thus preventing the actuation of valve 104.

Tab 232 can also have a notch 236. As shown, there are two notches 236. Each notch 236 is dimensioned to have a width greater than a width of blocker 218. When slidable body 208 is in the unblocked position, each notch 236 aligns with and is structured to receive blocker 218 therethrough.

Shroud 204 includes a slot 228 therethrough. Slot 228 is dimensioned and aligned to receive blocker 218 therethrough during the assembly of the operating state of actuator 200.

Slot 228 has a generally rectangular shape. Slot 228 has a top side 238, a bottom side 240, a left side 242, and a right side 244 defining a perimeter of the slot. Slot 228 can be concentric with slider 216.

As shown, tether 220 attaches to right side 244. Gates 214 are connected to bottom side 240. Slider 216 is slidable between left side 242 and right side 244.

Figure 5:
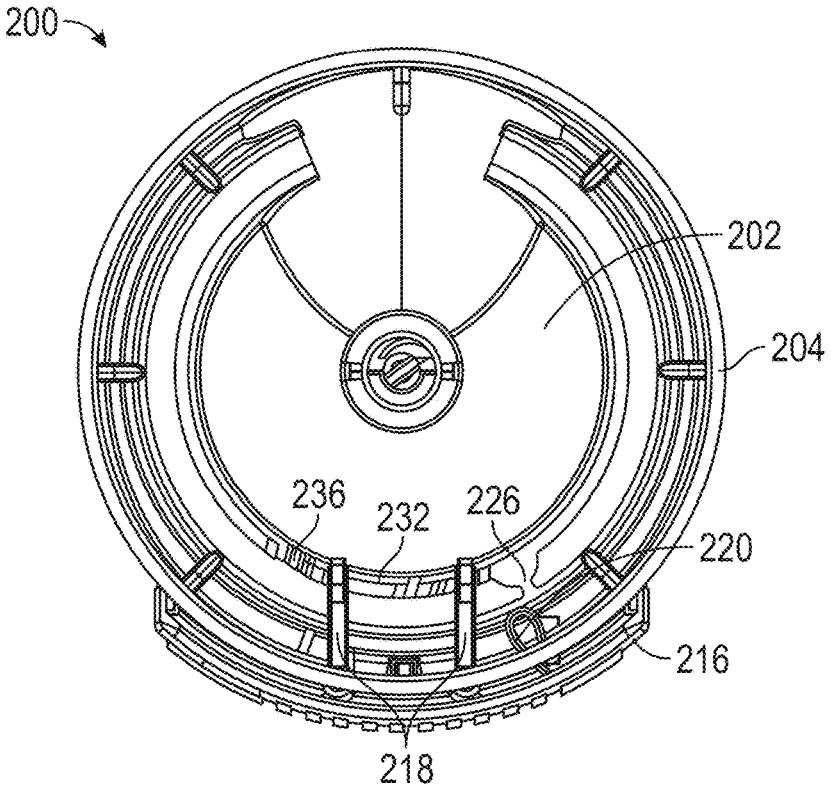
FIG. 5 is a bottom view of the actuator shown in FIG. 1 in an operating state.
Figure 6:
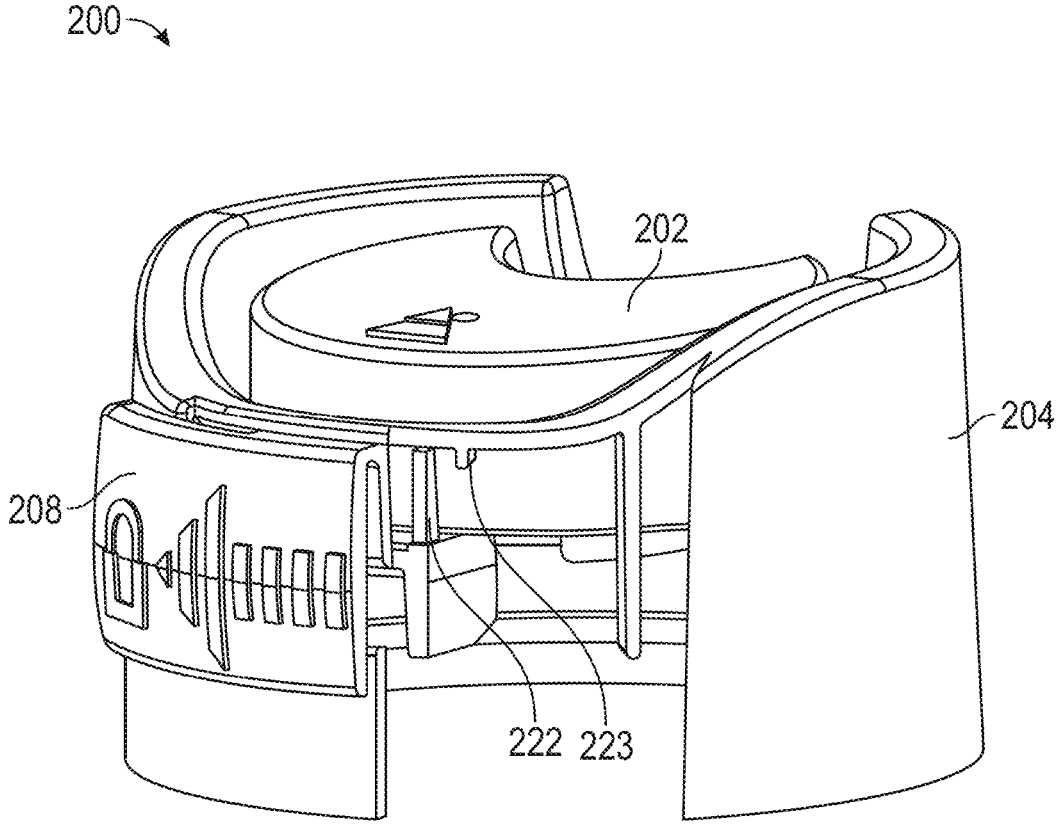
FIG. 6 is a perspective cutaway view showing an audible and/or tactile feature of the actuator shown in FIG. 1.

Reference is now made to FIG. 5, which shows actuator 200, as assembled, in an operating state, and, particularly, a blocked position. Namely, slidable body 208 has been moved radially inward. Blocker 218 is disposed through slot 228 and slider 216 is disposed adjacent to an outside surface of shroud 204.

In the operating position, slidable body 208 is slidable in slot 228 between a left side and a right side. The left and right sides correspond to a respective position that prevents the actuation of the valve and a position that permits the actuation of the valve.

As shown in FIG. 5, actuator 200 is in the blocked position. Tab 232 is aligned with blocker 218.

During the transition from the initial state to the operating state, tether 220 can guide slidable body 208 into the operating state of the actuator. Once in the operating state, tether 220 does not interfere with movement of slidable body 208 between the blocked and unblocked positions. As can be seen, tether 220 remains connected to shroud 204 and slidable body 208 so that the actuator is still one piece.

Figure 7:
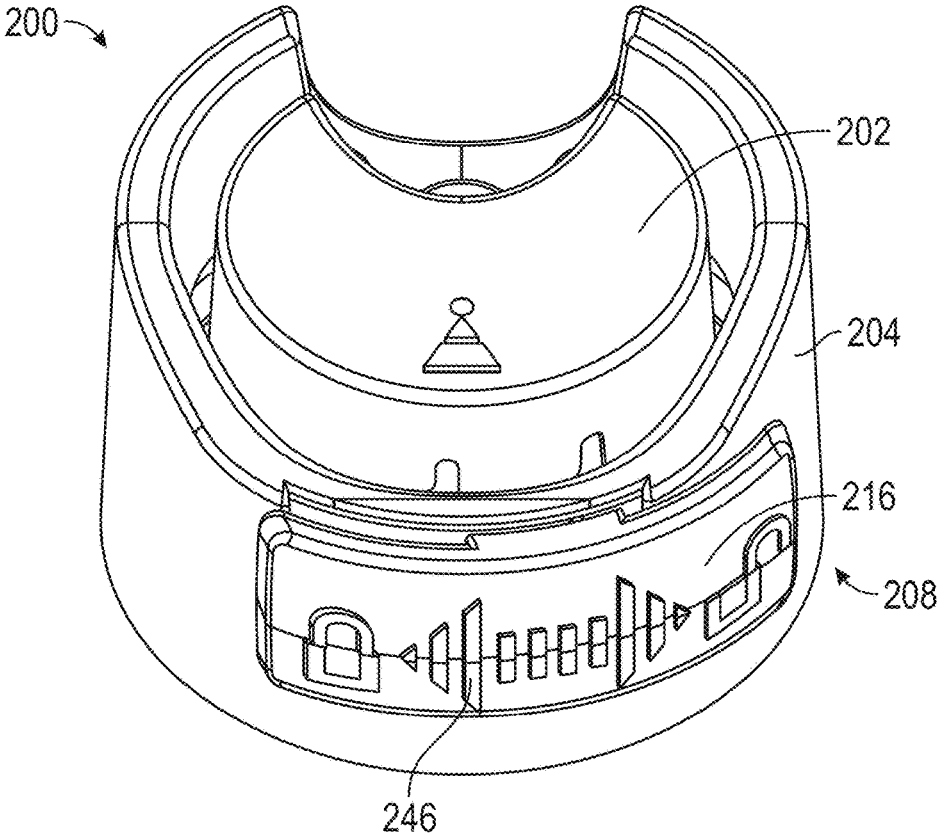
FIG. 7 is a rear perspective view of the actuator shown in FIG. 1 in a configuration in which the actuator is in an unblocked position.
Figure 8:
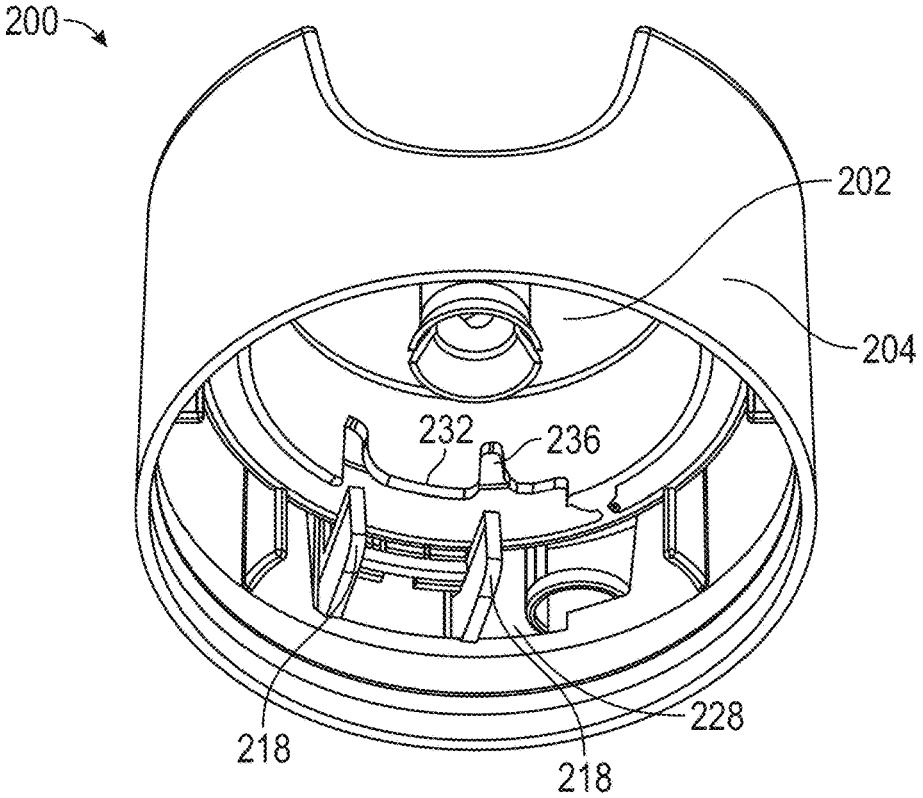
FIG. 8 is a bottom perspective view of the configuration shown in FIG. 7.

Reference is now made to FIGS. 7 and 8 that show actuator 200 in an unblocked position. Slider 216 is positioned at one end of slot 228. Blocker 218 is aligned with notch 236. Thus, upon application of a force to pushbutton 202, the pushbutton is movable so that valve 104 can be actuated.

Figure 9:
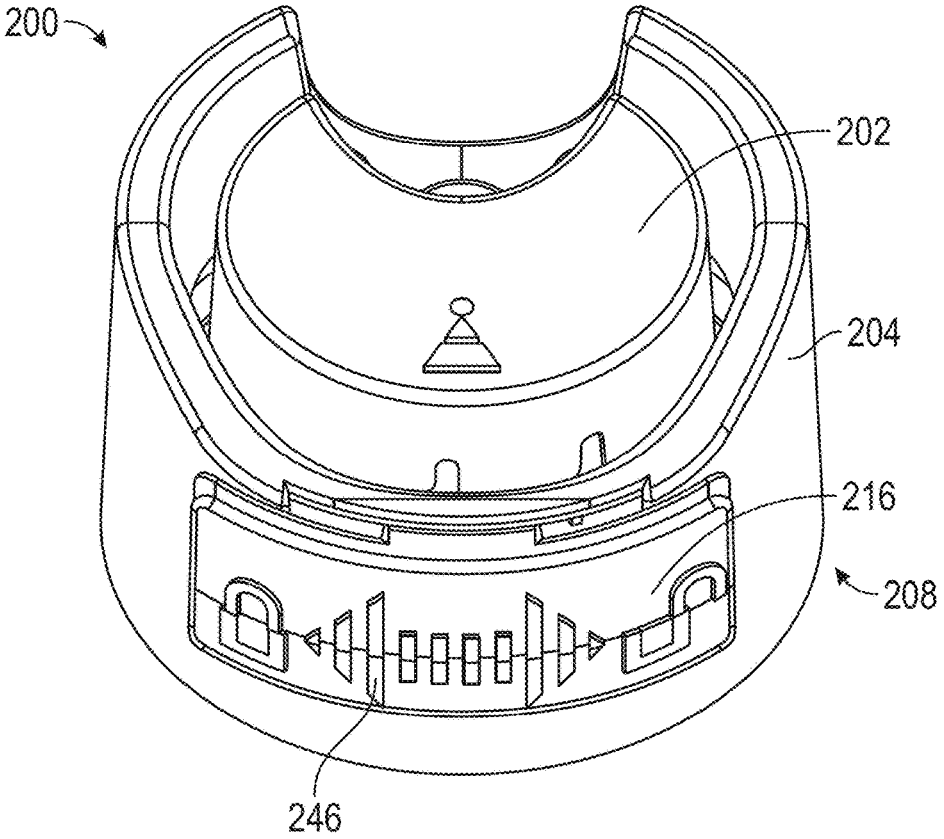
FIG. 9 is a rear perspective view of the actuator shown in FIG. 1 in a configuration in which the actuator is in a blocked position.
Figure 10:
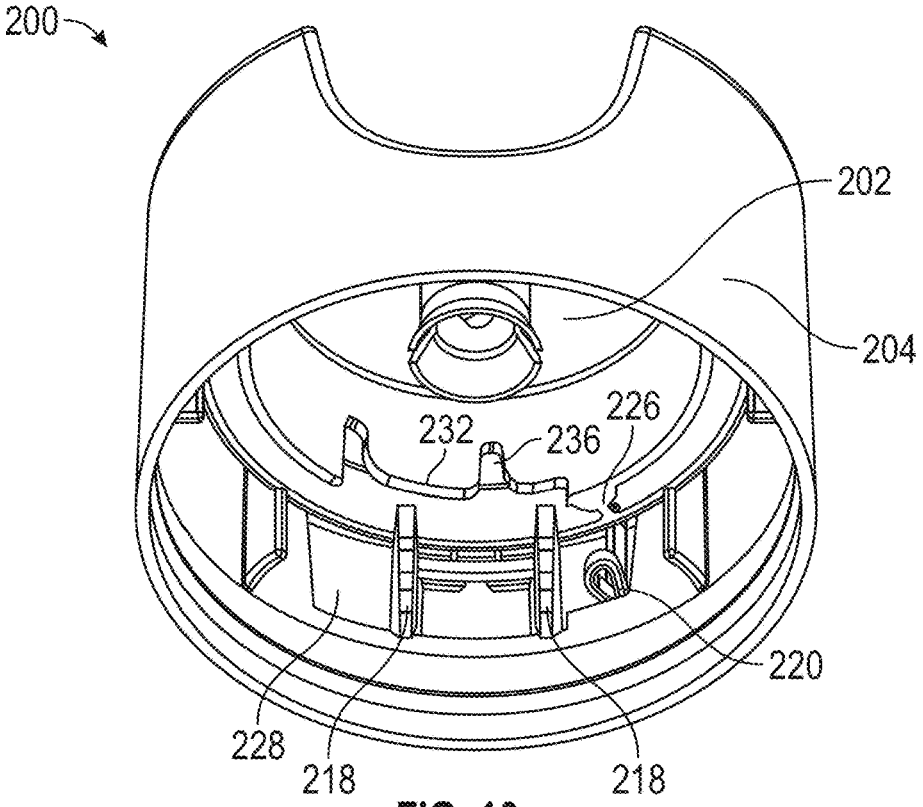
FIG. 10 is a bottom perspective view of the configuration shown in FIG. 8.
Figure 11:
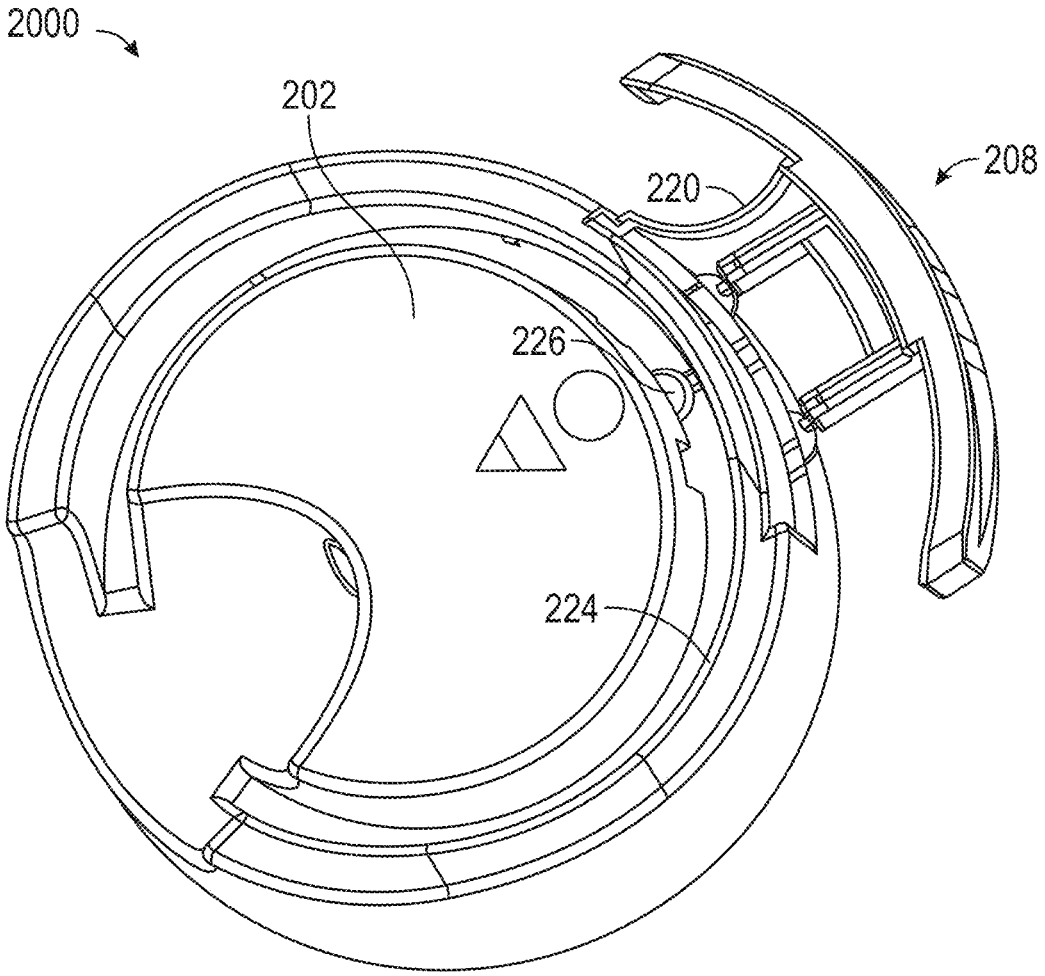
FIG. 11 is a top perspective view of another embodiment of an actuator according to the present disclosure.

Reference is now made to FIGS. 9 and 10 that show actuator 200 in a blocked position. Slider 216 is positioned at an end of slot 228 that is opposite to the end shown in FIG. 8. Blocker 218 is not aligned with notch 236. Here, blocker 218 is aligned with tab 232, which blocks downward movement. Thus, upon application of a force to pushbutton 202, the pushbutton is not movable and prevents actuation of valve 104.

Referring to FIGS. 8 and 10, tether 220 can also function as a spring. Tether 220 biases slidable body 208 to facilitate positioning the slidable body in the unblocked position. As shown in FIG. 10, in the blocked position, tether 220 is compressed relative to the unblocked position shown in FIG. 8.

Referring to FIGS. 7 and 9, slider 216 can have a grippable texture or surface feature 246 on an outside surface of the slider that facilitates user operation.

FIG. 10 shows an actuator 2000. Actuator 2000 differs from actuator 200 in that tamper-evident feature 226 and tether 220 are located differently on the actuator.

The rib of tamper-evident feature 226 is centered at a 6 o'clock position relative to an orientation of orifice 212.

Tether 220 is reversed. That is, tether 220 biases slidable body 208 toward the blocked position.

Figure 12:
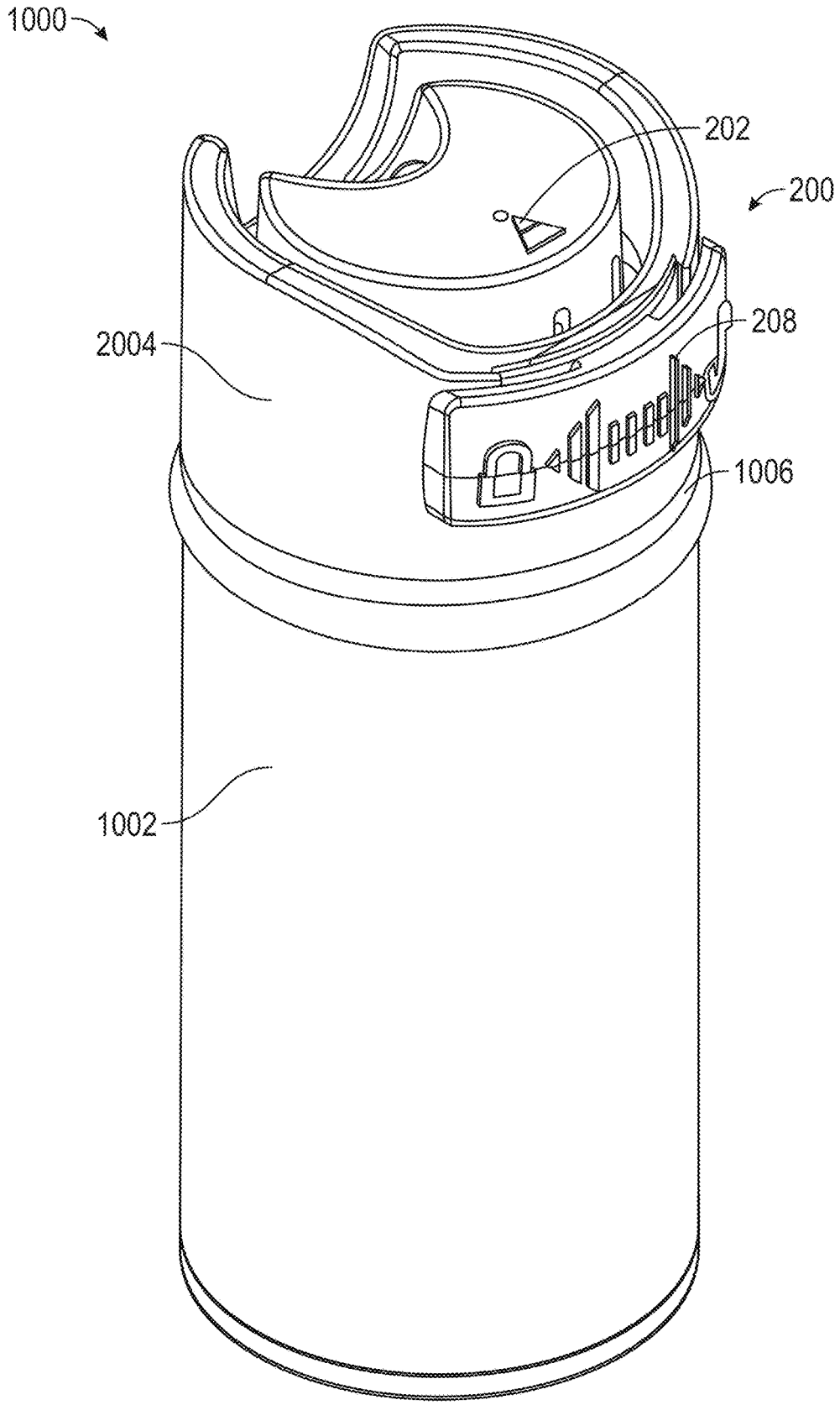
FIG. 12 is a rear isometric view of another container having an actuator according to the present disclosure.

FIG. 12 shows a dispensing system 1000. System 1000 differs from system 100 in that actuator 200 has a shroud 2004. Shroud 2004 differs from shroud 204 in that shroud 2004 is mountable on a cup 1006 of a container 10002 instead of a can.

Thus, the actuator or shroud can be structured to be mountable to a cup 1002 or a can of the container as shown in FIGS. 12 and 1, respectively.

Figure 13:
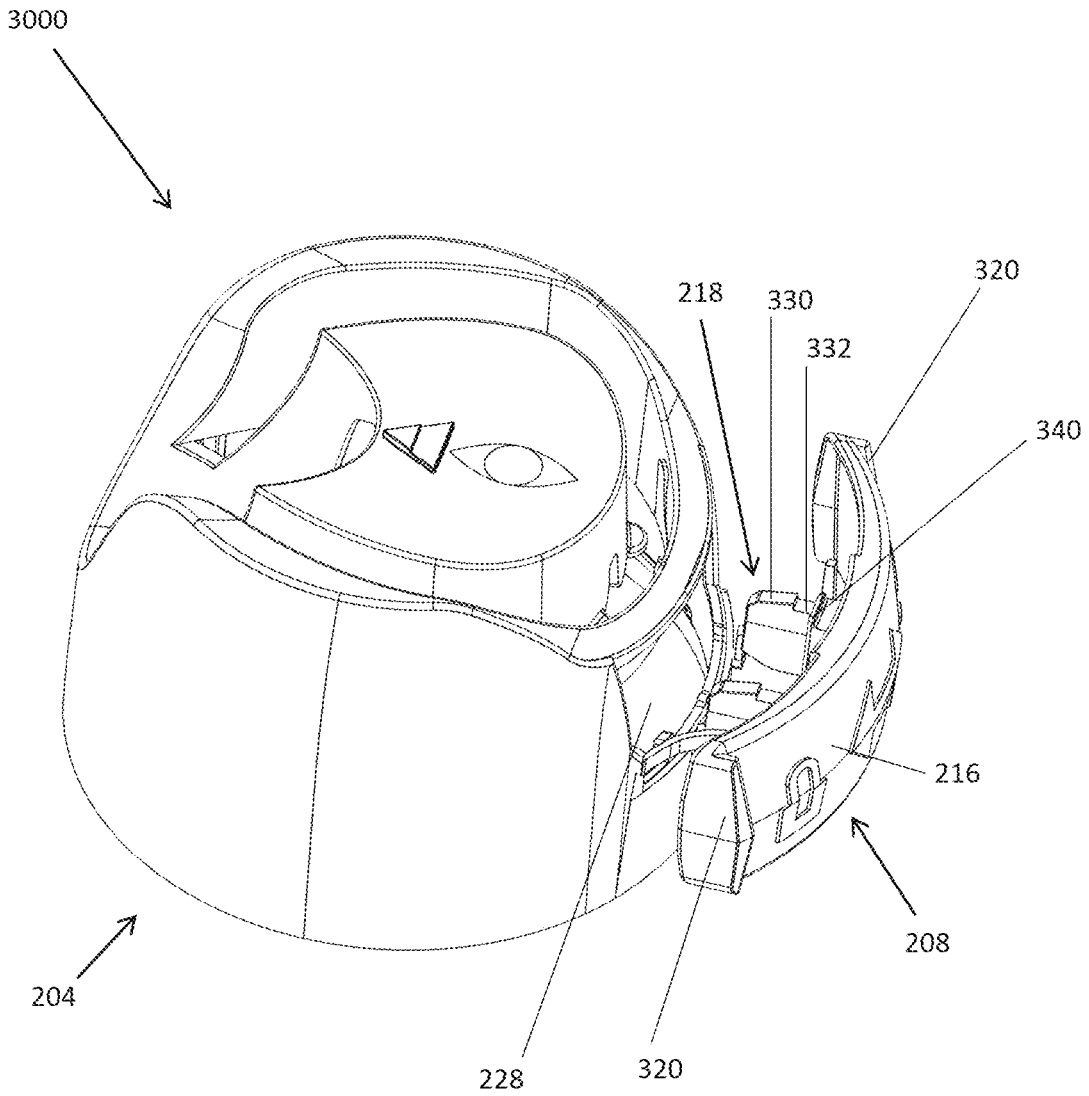
FIG. 13 is a top perspective view of another embodiment of an actuator according to the present disclosure shown in the initial state.
Figure 14:
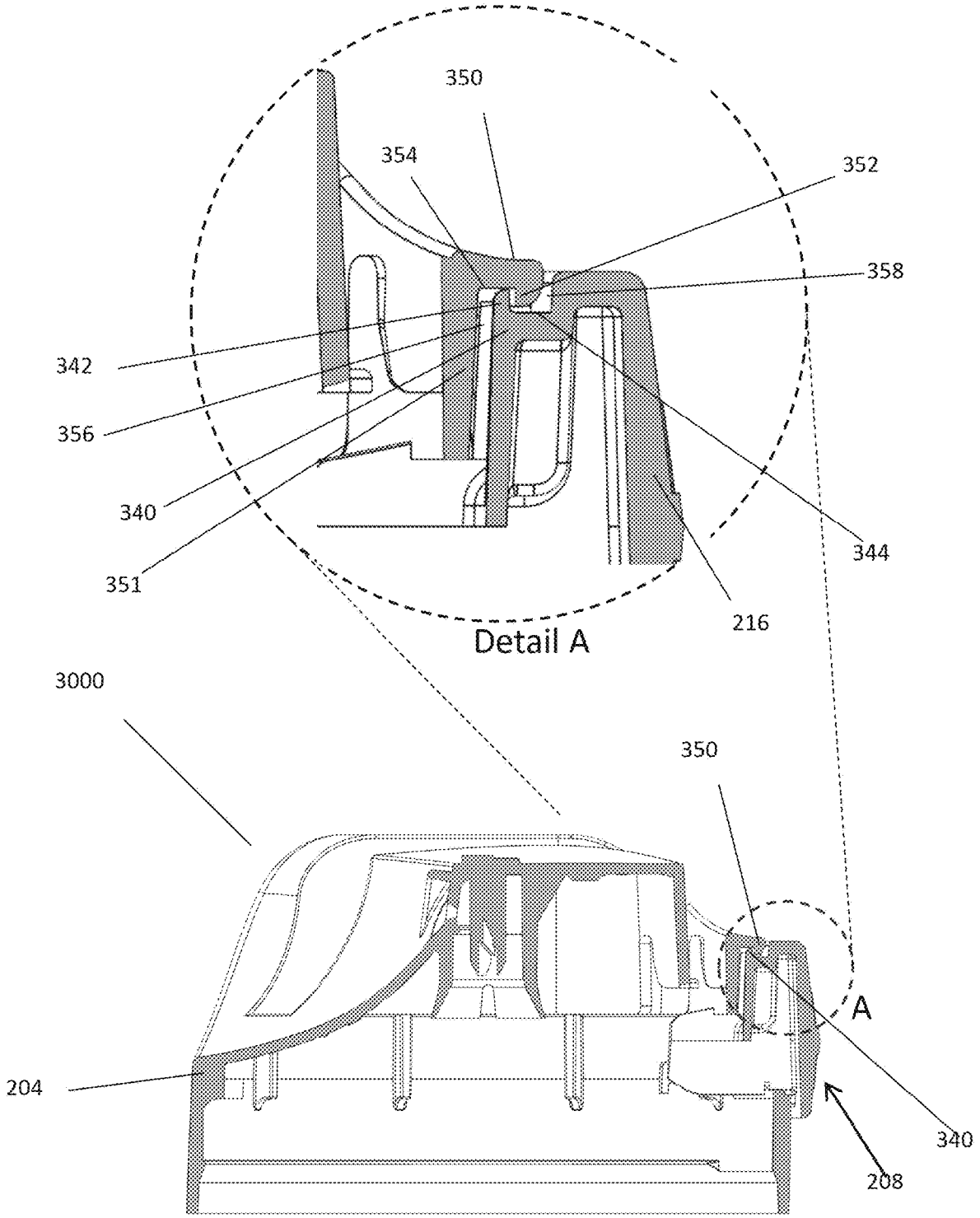
FIG. 14 is a section view with a detail view of the actuator of FIG. 13 shown in the operating state.

Referring now to FIGS. 13 and 14, an actuator 3000 is shown. FIG. 13 shows a perspective view of actuator 3000 in the initial state like in FIGS. 3 and 4. FIG. 14 shows a side section view thereof in the blocked position of the operating state like in FIG. 5. Actuator 3000 is similar to actuator 200 but has additional features that will be described below, namely finger-engageable tabs 320, lip 330, and a pair of interlocking retaining latches 340 and 350.

Actuator 3000 has one or more finger-engageable tabs 320 on slider 216 of slidable body 208.

Finger-engageable tabs 320 are protrusions that extend outward and away from the slider 216. As shown, there are two finger-engageable tabs 320. One finger-engageable tab 320 is located at a leftmost end of slider 216. The other finger-engageable tab 320 is located at a rightmost end of slider 216.

Finger-engageable tabs 320 facilitate the slidability of slidable body 208 between the left and right sides slot 228 corresponding to the blocked and unblocked positions. Finger-engageable 320 makes it easier for a user to apply a sliding force to operate slidable body 208, for example by engagement with their thumb. Without wishing to be bound by a particular theory, it is also believed that finger-engageable tabs 320 help to distribute a component of the sliding force inward towards slot 228, which in turn helps prevent slidable body 208 from being dislodged from the operating state.

It is contemplated that the protrusions can instead be or also include inward-facing depressions on the surface of slider 216, which is not shown.

Actuator 3000 also has lip 330 on blocker 218. Lip 330 has a slope that increases in a direction towards slider 216 and a down step that forms a groove 332 between the lip and the slider. In the operating state, lip 330 hooks into an inside wall 351 of shroud 204, which helps provide stability, controls fit gaps, and makes it difficult for actuator 3000 to revert back to the initial state once the operating state is achieved.

Actuator 3000 also has a pair of retaining latches 340 and 350 that help to keep slidable body 208 in the operating state and prevent it from being dislodged once in the operating state. Latches 340 and 350 also help slidable body 208 resist rocking and vertical tilting when forces are applied to it. Further, latches 340 and 350 help control desirable gaps 356, 358 between shroud 204 and slider 216 at the top slot 228.

Latch 340 is disposed at the top edge of slider 216, preferably in the center, as shown. Latch 340 includes a prong 342 and an upward-facing groove 344 disposed between the prong and an exterior of slider 216.

Latch 350 is disposed on shroud 204 at top side 238 of slot 228. Latch 350 includes a prong 352 and a downward-facing groove 354 disposed between the prong and inside wall 351 of shroud 204.

In the operating state, latch 340 is received by latch 350. Prong 352 is received and maintained in groove 344. Prong 342 is received and maintained in groove 354.

Actuator 200, optionally including one or more of the features of actuators 2000 and 3000, can be injection molded by injecting plastic into a mold. Actuator 200 is then assembled by applying an inward radially directed force to slidable body 208 to fracture gates 214 and push blocker 218 through slot 228 until slider 216 is adjacent to an outside surface of shroud 204.

The inward radially directed force can also cause the arcuate flexible tether to fold on itself and project through the slot so that the actuator is slidably lockable while being a single discrete component.

In example methods, the assembling is performed during the removal of the component from the mold. In other example methods, the assembling is performed after the removal of the component from the mold.

The injection molding can also be performed with one, or two, or more different plastics so that the actuator is co-molded or over-molded.

It should be noted that the terms "first", "second", "left", "right" and the like are used herein to modify various elements. These modifiers do not imply a spatial, sequential, or hierarchical order to the modified elements unless specifically stated.

While the present disclosure has been described with reference to one or more examples, it will be understood by those skilled in the art that various changes can be made and equivalents can be substituted for elements thereof without departing from the scope of the present disclosure. Therefore, it is intended that the present disclosure will not be limited to the particular examples disclosed, but that the disclosure will include all examples falling within the scope of the appended claims.

What is claimed is:

1. An actuator attachable to a container and that actuates a valve to dispense product from the container, the actuator comprising:

an initial state of the actuator;

an operating state of the actuator in which the actuator can be in a blocked position and an unblocked position;

a shroud mountable on the container, the shroud having a slot defined therethrough, the slot having a first side and a second side opposite the first side;

a conduit fluidly communicating a dispensing orifice at a first end of the conduit and the valve at a second end of the conduit that is opposite first end;

a pushbutton levered to the shroud to be reciprocally movable in the shroud between an actuated valve position and an non-actuated valve position, the pushbutton comprising a tab that projects downward from a bottom surface of the pushbutton;

a slidable body having a slider and a blocker, wherein the blocker extends from the slider and is disposed perpendicular or at an angle to the slider; and a gate connecting the blocker to the shroud in the initial state of the actuator, the gate being frangible by an inward radial movement of the slidable body to position the slidable body in the operating state of the actuator;

wherein the blocker is disposed through the slot and the slider is disposed adjacent to an outside surface of the shroud when the slidable body is positioned in the operating state of the actuator, wherein the slidable body is slidable between the blocked position at the first side of the slot and the unblocked position at the second side of the slot when the slidable body is in the operating state of the actuator, and wherein the blocker is positioned below the tab in the blocked position to prevent movement of the pushbutton to the actuated valve position when the slidable body is in the operating state of the actuator.

2. The actuator according to claim 1, further comprising a tether that is arcuate and flexible, wherein the tether connects the slider to the first end or the second end of the slot both when actuator is in the initial state and when the actuator is in the operating state.

3. The actuator according to claim 2, wherein the tether is arced away from the blocker.

4. The actuator according to claim 1, wherein the slidable body comprises a pair of spaced apart blockers and a respective pair of gates.

5. The actuator according to claim 1, wherein the slot has a bottom side and wherein the gate connects the blocker to the bottom side of the slot.

6. The actuator according to claim 1, wherein the blocker is a bar or a rod.

7. The actuator according to claim 1, wherein the gate is dimensioned so that the actuator is moldable as a single discrete component.

8. The actuator according to claim 1, wherein the initial state is an as-molded state or an as-additively manufactured state.

9. The actuator according to claim 1, wherein the slidable body comprises a grippable texture or surface feature on an outside surface of the slider.

10. The actuator according to claim 1, wherein the tab projects downward from an edge of the pushbutton.

11. The actuator according to claim 1, wherein the slider comprises a pair of finger-engageable tabs projecting outward at opposite ends of the slider.

12. The actuator according to claim 1, wherein the tab comprises a notch dimensioned to have a width greater than a width of the blocker.

13. The actuator according to claim 1, wherein the tab comprises a notch aligned and structured to receive the blocker therethrough when the slider is in the unblocked position.

14. The actuator according to claim 1, further comprising:

a clicking post disposed on the slidable body that produces a tactile and/or audible click when the clicking post passes over a projection that projects from the shroud; and/or a tamper evident feature that includes a frangible rib connecting the pushbutton to a top edge of the shroud.

15. The actuator according to claim 1, wherein the shroud is mountable to a cup or a can of the container.

16. The actuator according to claim 1, further comprising a pair of mutually interlocking retaining latches, wherein one of the latches is disposed on the shroud and the other one of the latches is disposed on the slidable body.

17. The actuator according to claim 1, wherein the blocker comprises a sloped lip projecting from a top surface of the blocker.

18. A method of making a slidably lockable actuator for actuating a valve to dispense a product from a container, the method comprising:

injecting plastic into a mold via a gate to form a component that has:

a shroud mountable on the container, the shroud having a slot defined therethrough, the slot having a first side and a second side opposite the first side, a conduit fluidly communicating a dispensing orifice at an end of the conduit with the valve at an opposite end of the conduit, a pushbutton levered to the shroud to be reciprocally movable in the shroud between an actuated valve position and an non-actuated valve position, the pushbutton comprising a tab that projects downward from a bottom surface of the pushbutton, a slidable body that has a slider and a blocker extending from the slider that is disposed perpendicular or at an angle to the slider, wherein the gate connects the blocker to the shroud; and assembling the actuator by applying an inward radially directed force to the slidable body to fracture the gate and push the blocker through the slot until the slider is adjacent to an outside surface of the shroud.

19. The method according to claim 18, wherein the component is molded to have an arcuate flexible tether connecting the slider to the first side or the second side of the slot, and wherein the inward radially directed force causes the arcuate flexible tether to fold on itself and project through the slot so that the actuator is slidably lockable while being a single discrete component.

20. The method according to claim 18, wherein the gate comprises at least two gates and the component is molded to have at least two blockers.

21. The method according to claim 18, wherein the assembling is performed during removal of the component from the mold.

22. The method according to claim 18, wherein the assembling is performed after removal of the component from the mold.

23. The method according to claim 18, wherein the injecting plastic comprises injecting one or more plastics so that the component is co-molded.

* * * * *